US005538350A

United States Patent [19]

Suzuki

[11] Patent Number: 5,538,350

[45] Date of Patent: Jul. 23, 1996

[54] RIBBON SUBCARTRIDGE

[75] Inventor: Hitoshi Suzuki, Yokohama, Japan

[73] Assignee: Mitsubishi Pencil Kabushiki Kaisha, Tokyo, Japan

[21] Appl. No.: 320,733

[22] Filed: Oct. 7, 1994

[30] Foreign Application Priority Data

Oct. 12, 1993 [JP] Japan ..... 5-55077 U

[51] Int. Cl.[6] ..... B41J 32/02

[52] U.S. Cl. ..... 400/196; 400/248

[58] Field of Search ..... 400/196, 191, 400/194, 207, 196.1, 208, 248.2, 248.1, 248, 247

[56] References Cited

U.S. PATENT DOCUMENTS

| | | | |
|---|---|---|---|
| 2,518,893 | 8/1950 | Huether | 400/248 |
| 4,113,750 | 9/1978 | Isobe | 400/196 |
| 4,161,270 | 7/1979 | Casey | 400/196.1 |
| 4,758,105 | 7/1988 | Nagasawa et al. | 400/196.1 |
| 4,867,587 | 9/1989 | Kishida et al. | 400/208 |
| 5,160,206 | 11/1992 | Haftmann et al. | 400/208 |
| 5,201,592 | 4/1993 | Mizutani et al. | 400/194 |

FOREIGN PATENT DOCUMENTS

| | | | |
|---|---|---|---|
| 0391836 | 10/1990 | European Pat. Off. | 400/208 |
| 0007374 | 1/1991 | Japan | 400/194 |
| 9422673 | 10/1994 | WIPO | 400/208 |

*Primary Examiner*—Edgar S. Burr
*Assistant Examiner*—Anthony H. Nguyen
*Attorney, Agent, or Firm*—Darby & Darby

[57] ABSTRACT

A ribbon subcartridge having an endless ribbon folded and held therein, and a plate member with a slit portion through which the ribbon passes. The plate member also includes a holding portion for holding the plate member during placement of the ribbon within a ribbon guiding passage of a ribbon cartridge in which the ribbon subcartridge is placed. Once the ribbon is properly positioned in the ribbon guiding passage, the plate member is attached to the ribbon cartridge. The shape and thickness of the plate member is selected so that the plate member is able to pass through the ribbon guiding passage in the ribbon cartridge, further facilitating ribbon replacement. Thus, a ribbon may be replaced without staining the operator's hands or clothes.

7 Claims, 1 Drawing Sheet

RIBBON SUBCARTRIDGE

BACKGROUND OF THE INVENTION (1) Field of the Invention

The present invention relates to a ribbon subcartridge having an endless ribbon accommodated in a folded state. The improved ribbon subcartridge may be mounted and used in a ribbon cartridge for serial dot printers and the like.

(2) Description of the Related Art

Ribbons used in serial dot printers and the like, are in general incorporated in ribbon cartridges to allow easy handling. That is, an endless ribbon held in a cartridge is transferred and delivered in time with printing operation by a transferring mechanism and the like arranged in the cartridge so that fresh or unexhausted ribbon may successively be supplied for printing.

As an additional known configuration, the aforementioned endless ribbon may be constructed such that two ends of the ribbon are joined by giving a half twist to form a so-called Mobius strip while a member (to be referred to as a Mobius member) which allows the ribbon to turn around as the ribbon passes therethrough is provided in the ribbon cartridge. This configuration enables the ribbon to be successively delivered using the two sides of the ribbon so that the ribbon can be effectively utilized to lengthen the life of the ribbon.

Ribbon cartridges of this kind are in general categorized into three types based on replacing methods of ribbons as the ribbon runs out or has been exhausted. A first type of them is replaced as a whole and a second type is renewed by only replacing the ribbon by using a ribbon subcartridge. Replacement of the other type is performed by the combination of the above two types.

A conventional ribbon subcartridge 1, for example, is constructed as shown in FIG. 3 such that ribbon 3 is stored in a cartridge case 2 by folding the ribbon 3 in zigzag form and the two ends of the ribbon 3 are fused together.

This configuration, however, suffers from a problem. That is, when replacing ribbon 3 is loaded from the subcartridge 1 into the ribbon cartridge, the operator must handle the ribbon directly by hands. As a result, operator's clothes as well as his or her hands may be stained. To deal with this, it is possible to use convenient or disposable gloves made of a synthetic resin. In this case, hands and clothes can be prevented from stains, but workability is deteriorated.

SUMMARY OF THE INVENTION

It is therefore an object of the present invention to provide a ribbon subcartridge which can provide facility for replacing the ribbon without staining operator's hands or clothes when the ribbon is loaded.

In accordance with a first aspect of the present invention, there is provided a ribbon subcartridge which comprises: an endless ribbon being folded and held therein; and a plate member having a slit portion through which the ribbon passes and a holding portion for ribbon placement, so that the plate member can be disposed on the ribbon, the plate member being attached to a ribbon cartridge.

In accordance with another aspect of the present invention, there is provided a ribbon subcartridge which comprises: an endless ribbon being formed such that two ends of a ribbon are connected to turn over the front and the back of the ribbon in forming an endless loop, so that a half twist can be given to the ribbon, and the ribbon being folded and held therein; and a plate member having a slit portion through which the ribbon passes and a holding portion for ribbon placement, the plate member being disposed on the ribbon extracted from the ribbon subcartridge to give a half twist to the ribbon during the conveyance of the ribbon and being constructed such as to be able to be attached to a ribbon cartridge.

In accordance with a further aspect of the present invention, there is provided a ribbon subcartridge which comprises: an endless ribbon being formed such that two ends of a ribbon are connected to turn over the front and the back of the ribbon in forming an endless loop, so that a half twist can be given to the ribbon; a cartridge case holding the ribbon in which the ribbon is folded; a lid portion covering the cartridge case; and a plate member having a slit portion through which the ribbon passes and a holding portion for ribbon placement, the plate member being disposed on the ribbon extracted from the ribbon subcartridge to give a half twist to the ribbon during the conveyance of the ribbon and being constructed such as to be able to be attached to a ribbon cartridge.

Further advantages, featrures as well as scope and nature of the present invention will become apparent to those skilled in the art upon making reference to the following detailed description of preferred embodiments of the present invention.

DESCRIPTION OF THE PREFERRED EMBODIMENTS

One embodiment of the present invention will be now described with reference to FIGS. 1 and 2, but the present invention should not be limited to this embodiment.

Figure 1:
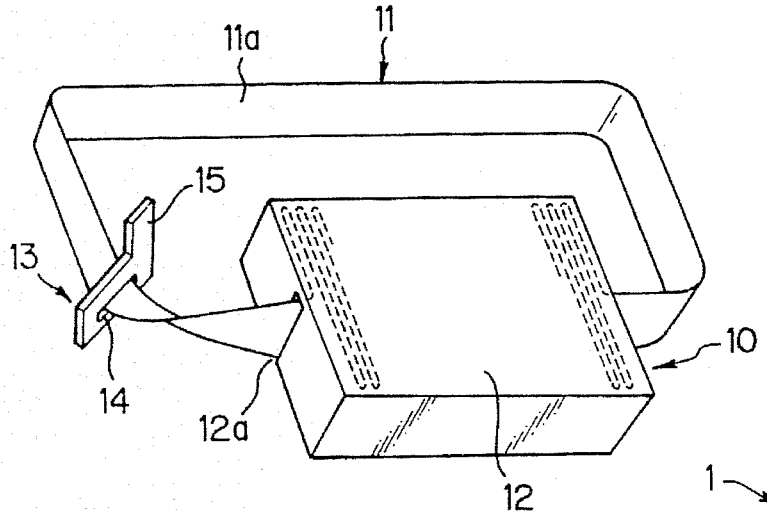
FIG. 1 is a perspective view showing an embodiment of a ribbon subcartridge in accordance with the present invention.
Figure 3:
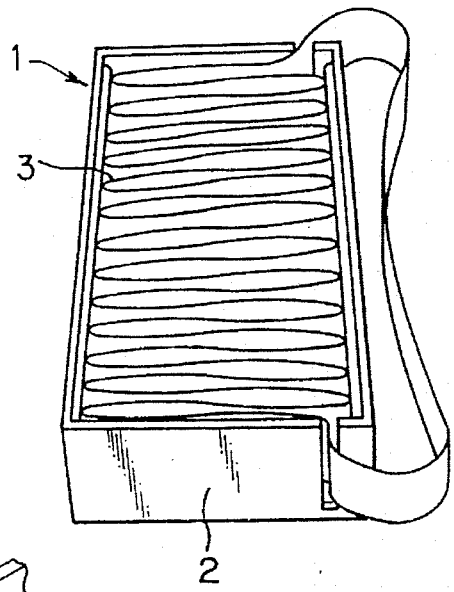
PRIOR ART FIG.3
FIG. 3 is a perspective view showing a conventional ribbon subcartridge.
Figure 2:
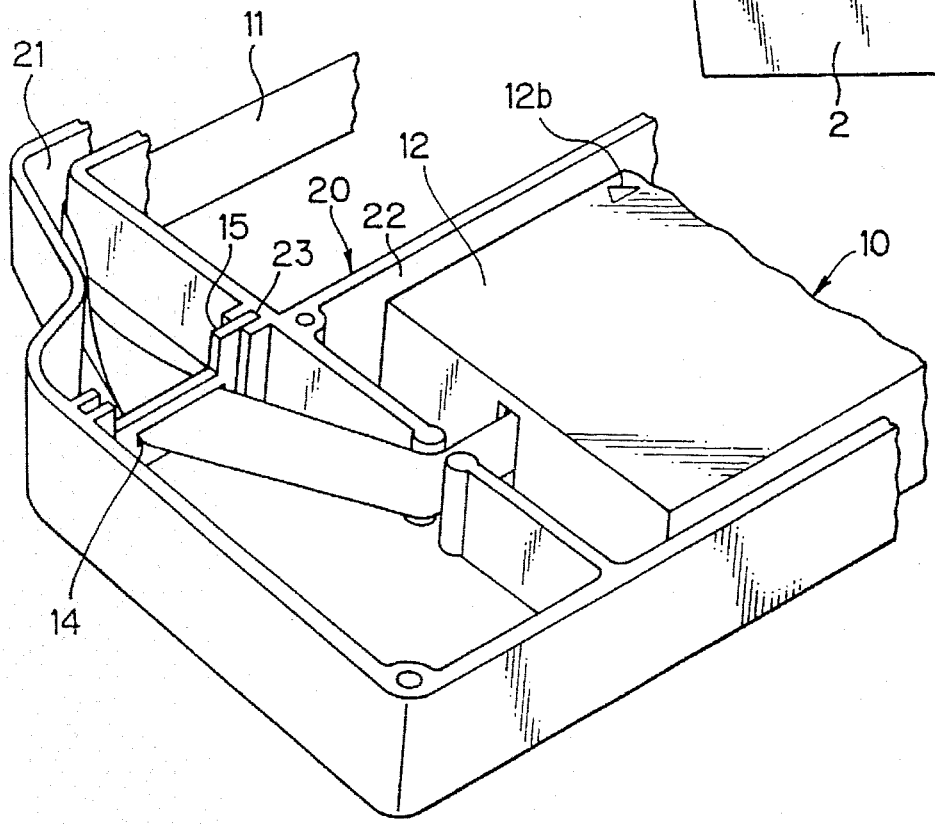
FIG. 2 is a partial perspective view showing a state in which a ribbon subcartridge of the present invention is loaded in a ribbon cartridge.

A ribbon subcartridge 10 in the present embodiment is constructed as shown in FIGS. 1 and 2 such that an endless ribbon 11 of which two ends are joined by giving a half twist to form a Mobius strip is folded and stored in a cartridge case (not shown) while the cartridge case is covered by a lid portion 12. Provided for the cartridge case is an unillustrated slit through which the ribbon 11 passes while the lid portion 12 has a slit portion **12*a* which is slightly set off the position of the slit of the cartridge case. As a result, when the lid portion 12 is fit on the cartridge case which accommodates the folded ribbon 11, the movement of the ribbon 11** is inhibited. Accordingly, there is no fear that a large quantity of the ribbon runs over or flows out from the ribbon subcartridge during shipping or transportation.

Here, a reference numeral **12*b* designates a direction indicator showing a direction along which the ribbon subcartridge 10 is loaded into a ribbon cartridge 20**.

A ribbon 11a extracted from the subcartridge 10 is provided with a plate member 13. The plate member 13 comprises a slit portion 14 through which the ribbon **11*a* passes and a holding portion 15 for ribbon placement. The shape of slit portion 14** is not limited to a particular form but the slit portion may be preferable shaped in T- or L-form.

The shape and thickness of the aforementioned plate member 13 is designed such as to enable the plate member to pass along a ribbon guiding passage 21. This feature preferably facilitates replacing operation of the ribbon. Here, the ribbon guiding passage 21 refers to all part of paths through which the ribbon 11 passes in the ribbon cartridge 20.

In thus constructed ribbon subcartridge 10, the plate member 13 with the slit portion 14 allowing the ribbon 11 to pass therethrough is fitted on the ribbon 11, thereafter two ends of the ribbon 11 are connected together by fusing.

Loading of the ribbon into the ribbon cartridge is performed as follows. That is, the subcartridge 10 which the unillustrated cartridge case is removed from is put into a loading portion 22 of ribbon cartridge 20 while the plate member 13 is moved from the ribbon withdrawing side along the ribbon guiding passage 21 of the ribbon cartridge by holding the aforementioned holding portion 15 for ribbon placement with thumb and fingers. This feature enables the operator to place the ribbon into the ribbon cartridge 20 without staining his or her hands. Then, the aforementioned plate 13 is removably attached to an attaching portion 23 made up of a pair of guide posts provided in predetermined positions in the ribbon cartridge 20. Thus, the replacement of the ribbon is complete.

In the present embodiment, since the shape and thickness of the plate member 13 is constructed such that the plate member 13 may pass along the ribbon guiding passage 21 of the ribbon cartridge 20, this feature makes it markedly easy to replace the ribbon.

Although the ribbon subcartridge of the present invention is constructed and used as above, the present invention will not be limited to the above embodiment and various changes and modifications can be made in design without departing from the scope of the invention.

In the above described embodiment, the structure and other features of the ribbon cartridge 20, for example, will not be limited to the above configuration as long as the plate member 13 having the slit portion 14 with the ribbon 11*a* passed therethrough and the holding portion 15 for ribbon placement is provided in an appropriate position in ribbon cartridge 20 as a Mobius member for giving a half twist to the ribbon.

According to the ribbon subcartridge of the present invention, after the plate member with the slit portion allowing the ribbon to pass therethrough is fitted on the ribbon, two ends of the ribbon are connected together by fusing. The ribbon subcartridge is loaded into the ribbon cartridge as follows. That is, after the ribbon subcartridge is transferred to the ribbon cartridge, the plate member is moved along the ribbon guiding passage in the ribbon cartridge by holding the holding portion for ribbon placement so that the ribbon is loaded in place. Then, the plate is attached to the predetermined position in the ribbon cartridge.

As a result, it is possible to provide facility for replacing the ribbon without staining operator's hands or clothes when the ribbon is replaced.

In addition, by constructing the shape and thickness of the plate member so that the plate member is able to pass through the ribbon guiding passage in the ribbon cartridge, further facility for replacement can be achieved.

What is claimed is:

1. A ribbon subcartridge for placing within a ribbon cartridge having a ribbon guiding passage therein, said ribbon subcartridge comprising:

an endless ribbon being folded and held within said ribbon subcartridge; and a plate member having a substantially closed slit defined therein, said ribbon being passed through said substantially closed slit such that said plate member encircles and is maintained on said ribbon and is movable along said ribbon, said plate member further including a holding portion extending away from said slit for holding and moving said plate member along said ribbon to facilitate placement of said ribbon within the ribbon guiding passage of the ribbon cartridge, said plate member being shaped for attachment to the ribbon cartridge within the ribbon guiding passage to hold said ribbon in place within the ribbon cartridge after said ribbon is positioned within the ribbon guiding passage.

2. The ribbon subcartridge according to claim 1, wherein said plate member is constructed such as to be able to pass through the ribbon guiding passage of the ribbon cartridge to facilitate positioning of said ribbon within the ribbon guiding passage.

3. The ribbon subcartridge according to claim 1, wherein said ribbon has first and second ends said first end having a half twist and being connected to said second end to thereby form an endless loop.

4. A ribbon subcartridge for placing within a ribbon cartridge having a ribbon guiding passage therein, said ribbon subcartridge comprising:

a ribbon having two ends, said ribbon being formed such that a half twist is formed between said two ends and said two ends are connected to each other to form an endless loop wherein said ribbon is folded and held within said ribbon subcartridge; and a plate member having a substantially closed slit formed therein through which said ribbon passes so that said plate member encircles and is maintained on said ribbon and is movable along said ribbon to facilitate placement of said ribbon within the ribbon guiding passage, said plate member further comprising a holding portion for holding and moving said plate member during ribbon placement within the ribbon guiding passage;

said plate member being disposed on the ribbon extracted from said ribbon subcartridge to guide said ribbon during the conveyance of the ribbon within the ribbon guiding passage, said plate member being constructed such as to be able to be attached to the ribbon cartridge within the ribbon guiding passage to hold said ribbon in place within the ribbon cartridge after said ribbon is positioned within the ribbon guiding passage.

5. The ribbon subcartridge according to claim 4, wherein said plate member is constructed such as to be able to pass through the ribbon guiding passage in the ribbon cartridge to facilitate positioning of said ribbon within the ribbon guiding passage.

6. A ribbon subcartridge for placing within a ribbon cartridge having a ribbon guiding passage therein, said ribbon subcartridge comprising:

a ribbon having two ends, said ribbon being formed such that a half twist is formed between said two ends and said two ends are connected to each other to form an endless loop;

a cartridge case for holding said ribbon and in which said ribbon is folded;

a lid portion covering said cartridge case; and a plate member having a substantially closed slit formed therein through which said ribbon passes, and a holding portion for holding and moving said plate member during ribbon placement, wherein said plate member is:

movable along said ribbon to facilitate placement of said ribbon within the ribbon guiding passage by holding and moving said holding portion;

disposed on the ribbon extracted from said ribbon subcartridge to guide said ribbon during the conveyance of said ribbon within the ribbon guiding passage, said substantially closed slit of said plate member encircling said ribbon so that said plate member is maintained on said ribbon; and constructed such as to be able to be attached to the ribbon cartridge within the ribbon guiding passage to hold said ribbon in place within the ribbon cartridge when said ribbon subcartridge is transferred to the ribbon cartridge with said ribbon in place within the ribbon guiding passage.

7. The ribbon subcartridge according to claim 6, wherein said plate member is constructed such as to be able to pass through the ribbon guiding passage in the ribbon cartridge to facilitate positioning of said ribbon within the ribbon guiding passage.

* * * * *

UNITED STATES PATENT AND TRADEMARK OFFICE

CERTIFICATE OF CORRECTION

PATENT NO. : 5,538,350

DATED : July 23, 1996

INVENTOR(S) : Hitoshi SUZUKI

It is certified that error appears in the above-identified patent and that said Letters Patent is hereby corrected as shown below:

In the cover page of the patent, Section [30], please delete "5-55077U" and insert therefor --HEI 5-55077--.

Signed and Sealed this

Twelfth Day of November, 1996

*Attest:*

*Attesting Officer*

BRUCE LEHMAN

*Commissioner of Patents and Trademarks*